US009315023B2

(12) United States Patent
Fukasawa

(10) Patent No.: US 9,315,023 B2
(45) Date of Patent: Apr. 19, 2016

(54) INKJET PRINTER AND PRINTING METHOD

(71) Applicant: MIMAKI ENGINEERING CO., LTD., Nagano (JP)

(72) Inventor: Tsutomu Fukasawa, Tokyo (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/426,382

(22) PCT Filed: Sep. 5, 2013

(86) PCT No.: PCT/JP2013/073929
§ 371 (c)(1),
(2) Date: Mar. 5, 2015

(87) PCT Pub. No.: WO2014/038627
PCT Pub. Date: Mar. 13, 2014

(65) Prior Publication Data

US 2015/0224765 A1 Aug. 13, 2015

(30) Foreign Application Priority Data

Sep. 7, 2012 (JP) ..... 2012-197907

(51) Int. Cl.
*B41J 2/145* (2006.01)
*B41J 19/20* (2006.01)
*B41J 3/28* (2006.01)

(52) U.S. Cl.
CPC .. *B41J 2/145* (2013.01); *B41J 3/28* (2013.01); *B41J 19/20* (2013.01)

(58) Field of Classification Search
CPC ..... B41J 2/1752; B41J 19/005; B41J 19/202; B41J 25/304; B41J 25/34
USPC ..... 347/37
See application file for complete search history.

(56) References Cited

U.S. PATENT DOCUMENTS

| | | | | |
|---|---|---|---|---|
| 6,296,403 | B1 * | 10/2001 | Duchovne | 400/23 |
| 2002/0122093 | A1 * | 9/2002 | Otsuka | 347/40 |
| 2012/0182336 | A1 * | 7/2012 | Itoh et al. | 347/8 |

FOREIGN PATENT DOCUMENTS

| | | |
|---|---|---|
| JP | 2000-301775 | 10/2000 |
| JP | 2001-239653 | 9/2001 |
| JP | 2002-361852 | 12/2002 |
| JP | 2004-148666 | 5/2004 |
| JP | 2004-172317 | 6/2004 |

OTHER PUBLICATIONS

Mimaki Engineering Co., Ltd., "Product information of [UJF-3042HG]", http://www.mimaki.co.jp/bid/9/eid/365/, retrieved on Aug. 28, 2013, with English translation as provided in "http://eng.mimaki.com.jp/bid/9/eid/365/" thereof.

(Continued)

*Primary Examiner* — Manish S Shah
*Assistant Examiner* — Roger W Pisha, II
(74) *Attorney, Agent, or Firm* — Jianq Chyun IP Office

(57) ABSTRACT

It aims to provide an inkjet printer and a printing method that appropriately performs printing with high accuracy on print objects having various shapes. As a solution therefor, an inkjet printer is configured to perform printing using an inkjet scheme on a print object and includes an inkjet head that discharges ink droplets, a guide rail that retains the inkjet head by making the inkjet head face the print object and that is a Y direction extending member extending in a predeterminedly set Y direction, and an X direction driving section that moves the guide rail in an X direction and upon printing, the inkjet head moves along the guide rail and discharges ink droplets toward the print object, and the X direction driving section includes a ball screw and moves the guide rail in the X direction in accordance with a rotation amount of the ball screw.

10 Claims, 6 Drawing Sheets

(56) References Cited

OTHER PUBLICATIONS

"International Search Report (Form PCT/ISA/210)", mailed on Nov. 26, 2013, with English translation thereof, pp. 1-4, in which three of the listed references (JP2004-148666, JP2000-301775, JP2002-361852, JP2001-239653 and JP2004-172317) were cited.

"First Office Action of China Counterpart Application", issued on Sep. 2, 2015, pp. 1-19, with English translation thereof.

* cited by examiner

INKJET PRINTER AND PRINTING METHOD

CROSS-REFERENCE TO RELATED APPLICATION

This application is a 371 application of the International PCT application serial no. PCT/JP2013/073929, filed on Sep. 5, 2013, which claims the priority benefits of Japan Patent Application No. 2012-197907, filed on Sep. 7, 2012. The entirety of each of the above-mentioned patent applications is hereby incorporated by references herein and made a part of this specification.

TECHNICAL FIELD

The present invention relates to an inkjet printer and a printing method.

BACKGROUND ART

In the recent years, an inkjet printer is used for purposes of printing on various print objects. For example, conventionally, an inkjet printer that can perform printing on various print objects such as three-dimensional objects is known. As such a printer, for example, UJF-3042HG type of print device manufactured by Mimaki Engineering Co., Ltd. and the like are known (for example, see Non-Patent Document 1). This print device is an inkjet printer that can perform printing on a three-dimensional object placed in a region of 30 cm×42 cm.

PRIOR ART DOCUMENT

Non-Patent Document

Non-Patent Document 1: Product information of [UJF-3042HG], [online] on webpage of Mimaki Engineering Co., Ltd., April 2012, Mimaki Engineering Co., Ltd., [Searched on Aug. 28, 2013], Internet <URL: http://www-.mimaki.co.jp/bid/9/eid/365/>

SUMMARY OF THE INVENTION

Problem to be Solved by the Invention

In case of attempting to perform printing on various print objects, for example, enlargement of a printable region is desired. Further, to achieve this, for example, a distance by which an inkjet head is performed with a main scanning (scanning) upon printing (main scanning distance) needs to be made larger.

However, to enlarge the main scanning distance, changes such as elongating a member supporting the inkjet head performing the main scanning (guide rail and the like) become necessary. Further, as a result, weight of a constituent portion that is so-called a Y bar, which is a portion including the guide rail and the like, becomes heavier.

Moreover, the inventor of the present application has found, as a result of an in-depth study, that print quality is deteriorated in some cases by the aforementioned change in the configuration in case of elongating the main scanning distance of the inkjet head. Further, especially, for example, it has been found that this problem becomes more prominent in cases with a high position of center of gravity such as in the inkjet printer that performs printing on the three-dimensional object. Due to this, for example, if the printable region is to be made larger, a configuration of the inkjet printer suitable for the purpose is being desired. Thus, the present invention aims to provide an inkjet printer and a printing method that can solve the above problem.

Solutions to the Problem

In an inkjet printer, a Y bar is normally provided at an upper position in a direction of gravity. Due to this, when this portion becomes heavy, weight at the high position in the inkjet printer becomes large and thus a position of center of gravity of the inkjet printer becomes high. Further, in case of an inkjet printer that performs printing on a three-dimensional object, since the Y bar is provided at a position where the maximum height of the printable three-dimensional object is taken into consideration, the position of center of gravity becomes especially high.

Moreover, the inventor of the present application has found that, in connection to such a configuration, the weight of the Y bar and the like becoming large brings forth greater influence of vibration generated upon printing. Further, as a result, for example, in case where the printable region is attempted to be further enlarged, it has been found that the mere change in the length (width in a Y direction) of the guide rail and the like in the conventional inkjet printer cannot enable suitable printing in some cases. Further, the inventor of the present application has conducted further in-depth study on a relationship of vibration and print quality deterioration. Moreover, it has been discovered that image quality deterioration is generated by the influence of the vibration generated upon moving the Y bar.

To explain more specifically, in the inkjet printer, the inkjet head needs to be moved relatively with respect to the print object in order to perform printing on respective portions of the print object. Due to this, for example, the inkjet head is moved relatively with respect to the print object by moving the inkjet head along a guide rail in the Y bar in a predetermined Y direction (main scanning direction). Further, the inkjet head discharges ink droplets onto the print object at respective positions in the Y direction by performing a main scanning operation (scanning operation) to discharge the ink droplets while moving in the Y direction.

Further, in an X direction that intersects perpendicularly with the Y direction, for example, the inkjet head is moved relatively with respect to the print object in between the main scanning operations. More specifically, for example, in an inkjet printer that performs printing on a three-dimensional object, the inkjet head is moved relatively with respect to the print object by moving the Y bar in the X direction by a predetermined distance. Due to this, a feed operation that sequentially changes the region where printing is to be performed within the print object by the oncoming main scanning operation is performed.

Here, in this feed operation, not only the inkjet head but also an entirety of the Y bar is moved, so driving force required for the feed operation also becomes large. Due to this, upon the completion of each feed operation, impact generated upon stopping the motion of the Y bar becomes large accordingly. Further, vibration of the Y bar is likely generated by the impact. Further, for example, the vibration becomes large for cases where the weight of the Y bar is heavy, or the position of center of gravity is high.

Moreover, the inventor of the present application has found, from his in-depth study, that the vibration that was generated upon the feed operation stop continues even after the start of the subsequent main scanning operation and imposes influence of the print quality in cases where for example the weight of the Y bar is heavy or the position of center of gravity is high. More specifically, for example, in cases where the weight of the Y bar is heavy or the position of center of gravity is high, the vibration of the Y bar is likely generated, and the time required for attenuation of the generated vibration is assumed to be elongated. Due to this, in this case, for example, if the feed operation is performed by the configuration that is identical to the conventional one and the main scanning operation is performed at the same timing as the conventional one thereafter, printing is performed in a state where the vibration of the Y bar has not yet been sufficiently attenuated, and the print quality is assume to be deteriorated thereby. Thus, based on the recognition of this problem, the inventor of the present application has further conducted an in-depth study on a method for moderating the vibration generated upon feed operation stop. Moreover, in this in-depth study, the inventor of the present application has focused on a configuration of a driving section that is to be a power source of the feed operation.

For example, in the conventional print device, the Y bar is moved by a belted drive of a timing belt and the like to realize the feed operation. With respect to this, the inventor of the present application has found that the major cause of vibration generated upon the feed operation stop lies in the configuration to perform this belted drive.

More specifically, for example, in case of performing the feed operation by the belted drive, it has been found that there are cases where stopping position accuracy is decreased as a result of expansion and contraction of the belt by stress. Further, in case of performing the feed operation by the belted drive, for example, a configuration that uses a worm gear and a pulley is used, wherein an error is generated in the stopping position accuracy also by the influence of eccentricity between the worm gear and the pulley. Moreover, the stopping position accuracy of the belted drive receives influence of an amount of play in a reduction gear used in a motive force transmission path.

Moreover, for example, in cases where the weight of the Y bar is heavy or the position of center of gravity is high, vibration is likely generated by the influence of the error range of the stopping position. Further, the vibration is likely to continue even after the start of the main scanning operation taking place thereafter. Moreover, as a result, influence is expected to be imposed on the print quality. Further, in case of performing the feed operation by the belted drive, the influence of the vibration becomes large, and highly accurate printing becomes difficult to be performed at a suitable speed in some cases. Thus, the inventor of the present application has thought of suppressing the vibration by performing the feed operation by a more appropriate method that would replace the belted drive. To solve the above problem the present invention has the following configurations.

(Configuration 1) There is provided an inkjet printer configured to perform printing using an inkjet scheme on a print object, the inkjet printer including an inkjet head that discharges ink droplets, a Y direction extending member that retains the inkjet head by making the inkjet head face the print object and that extends in a Y direction predeterminedly set in the inkjet printer, and an X direction driving section that moves the Y direction extending member in an X direction orthogonal to the Y direction, wherein upon printing, the inkjet head moves along the Y direction extending member and discharges the ink droplets toward the print object, and the X direction driving section includes a ball screw, and moves the Y direction extending member in the X direction in accordance with a rotation amount of the ball screw.

The inkjet head discharges the ink droplets while moving along the Y direction extending member, and performs a main scanning operation (scanning operation). The X direction driving section for example moves the Y direction extending member between main scanning operations. Further, due to this, the X direction driving section performs feed operation between main scanning operations.

In case of configuring as above, by using the ball screw, compared to a case for example of performing the belted drive, feed resolution can be refined without changing feeding speed, and the Y direction extending member can be moved at a higher resolution. Further, as a result, the generation of vibration can be suppressed further at a timing of stopping the motion of the Y direction extending member. Due to this, by configuring as above, for example, the influence of vibration after the start of the subsequent main scanning operation can appropriately be suppressed. Further, due to this, printing with high accuracy can appropriately be performed.

(Configuration 2) A platform section being a platform-shaped member provided on a lower side in a direction of gravity than the inkjet head and the Y direction extending member, a guiding member that guides movement of the direction extending member in the X direction by a structure that extends in the X direction on the platform section, and a supporting member being a member that supports the Y direction extending member on the platform section and that includes a guided section movable in the X direction along the guiding member are further provided.

By configuring as above, for example, the Y direction extending member can appropriately be moved by the X direction driving section. Further, due to this, highly accurate printing can be performed more appropriately. It should be noted that in the X direction, the supporting member moves for example along the guiding member. Further, the guiding member is for example a rail.

(Configuration 3) At least two supporting members and two guiding members are provided, each of the two guiding members is provided at a corresponding end side in the Y direction of the platform section, and the guided section in each of the two supporting members is guided by a corresponding one of the two guiding members.

By configuring as above, for example, the Y direction extending member can more appropriately be supported. Further, the Y direction extending member can more appropriately be moved by the X direction driving section.

(Configuration 4) A leg section that supports the platform section on a mounting surface to mount the inkjet printer is further provided, wherein the leg section includes a connecting section that is provided in parallel in an elongate shape with the guiding member at a surface on an opposite side of a surface of the platform section where the guiding member is provided, and a plurality of projecting sections that supports the platform section on the mounting surface by projecting downward in the direction of gravity from the connecting section and making contact with the mounting surface.

The inventor of the present application has realized a highly accurate feed operation by using the ball screw and has further conducted in-depth study for printing with even higher accuracy even after the influence of vibration has been suppressed. Moreover, as a new problem that was not recognized in a conventional configuration having large influence of vibration, a problem of an influence of distortion (warpage) and the like generated in the platform section has been found. More specifically, for example, in case of moving the Y direction extending member in the X direction, a position where the weight is applied changes within the platform section by the movement. Then, as a result, distortion is generated in the platform section according to the Y direction extending member. And, this distortion is assumed to apply a certain influence on the print quality.

Here, for example, in case where the influence of the vibration generated upon the feed operation is large, the influence of the distortion is small compared to the influence that the vibration imposes on the print quality. Due to this, in this case, the influence of the distortion is less likely to become problematic. Contrary to this, in case where the highly accurate feed operation is realized by using the ball screw and the influence of vibration is thereby suppressed, the influence that the distortion generated in the platform section imposed on the print quality cannot be ignored.

Thus, from his in-depth study, the inventor of the present application has considered that such a connecting section is used to suppress the distortion of the platform section. Further, by this configuration, it has been found that the influence of the distortion in the platform section on the print quality can appropriately be suppressed. That is, by using the connecting section as above, for example, the platform section can be strengthened, and the rigidity of the platform section can appropriately be improved. Further, due to this, the distortion generated in the platform section by receiving the weight of the Y direction extending member and the like on the guiding member can appropriately be suppressed. Due to this, by configuring as above, for example, the highly accurate printing can be performed more appropriately.

(Configuration 5) The connecting section is provided at a position facing the guiding member with the platform section being sandwiched in between, and the projecting sections are provided at positions facing the guiding member with the connecting section and the platform section being sandwiched in between.

In case of configuring as above, for example, in the direction of gravity, the leg section is provided just below the guiding member, and the guiding member, the connecting section, and the projecting sections are aligned on one straight line. Due to this, by configuring as above, the guiding member and the platform section are more appropriately strengthened, and the distortion in the platform section can more appropriately be suppressed. Further, due to this, for example, highly accurate printing can be performed more appropriately.

(Configuration 6) The connecting section is provided at a position that is to be just below the guided section in the direction of gravity or in a vicinity thereof. By configuring as above, for example, even when vibration is generated in the Y bar and the like during the feed operation, the vibration can be suppressed at an early stage. Further, in this case, the projecting sections are preferably arranged just below the connecting section or in the vicinity thereof.

As above, by using the ball screw in the X direction driving section, a configuration in which vibration is less likely to be generated upon the feed operation can be realized. However, to suppress the vibration more appropriately, a structure of a guided section that supports weight of the Y direction extending member and the like at a portion that moves in the X direction by driving force transmission of the ball screw is also important. With respect to this, in case of configuring as above, since the connecting section of the leg section resides just below the guided section, or the guiding member for guiding the guided section, or in the vicinity thereof, it can be said as being a configuration in which vibration is easily attenuated even when the vibration is generated, that is, a configuration with high attenuating rate. Further, as a result, even in cases where vibration is generated, the vibration does not continue for a long time, and the vibration can be tranquilized at an early stage. Further, due to this, for example, next main scanning operation can be started early after the feed operation.

(Configuration 7) A print object mounting section on which the print object is mounted is further provided, wherein each of the Y direction extending member and the guided section is arranged above and under each other by being apart in the direction of gravity, with a portion where the print object is mounted in the print object mounting section as a center.

In case of configuring as above, since a configuration is such that a portion where the print object is mounted is set as a center in the print object mounting section, the Y direction extending member is arranged on one side, and the guided section is arranged on the other side, for example, the center of gravity of the Y bar, which is a portion including the Y direction extending member and being a portion that moves in the X direction in the feed operation, and the guiding member guiding the movement of the Y bar are separated, and a distance between them becomes large. Due to this, in this case, if the feed operation is performed by the belted drive, the problem of vibration is likely to occur. More specifically, for example, a belt such as a timing belt and the like is extended by stress being applied thereto upon driving. On the other hand, the belt returns to its original state by shrinking by relaxing of the stress upon a stop. Due to this, when the feed operation is performed by the belted drive, the vibration from the belt shrinking by the stress relaxation upon the stop is transmitted to the guided section. Further, it is assumed that by the configuration in which the center of gravity of the Y bar and the guiding member are separated, the vibration is amplified to generate vibration on the Y bar. Moreover, in case of using the timing belt, at a timing when a teeth of the belt switching to another teeth, smoothness is somewhat reduced, and the operation becomes awkward. Moreover, the reduction in the smoothness also becomes a cause of the vibration, and is transmitted to the Y bar by being amplified. Due to this, in the case of the configuration in which the center of gravity of the Y bar and the guiding member are separated, it is assumed that the problem of vibration is especially likely to be generated when the feed operation is performed by the belted drive.

In contrast, in the case where the ball screw is used in the X direction driving section, the above problem generated in the case of performing the belted drive can appropriately be resolved. Further, due to this, also in the case of the configuration in which the center of gravity of the Y bar and the guiding member are separated, the influence of vibration can appropriately be suppressed, and highly accurate printing can be performed appropriately.

By the way, as a configuration to perform the feed operation in the inkjet printer, for example, other than the configuration that moves the Y bar side, a configuration is known in which a position of the inkjet head in the X direction is fixed, and the table on which the print object is to be mounted (print object mounting section) is moved. However, in this case, a distance between the portion for mounting the print object on the table and the guiding member that guides the movement of the table can be said to be relatively small. Due to this, for example, even if the movement of the table is performed by the belted drive, the aforementioned problem of vibration is unlikely to be generated. Further, as a result, in case where the table is moved in the feed operation, the problem that the print quality lowers by vibration is expected not to be generated substantially. Accordingly, it is assumed that in case of moving the table in the feed operation, the ball screw does not need to be used for the purpose of suppressing the vibration.

(Configuration 8) A width in the Y direction of a region where the inkjet head performs printing by moving along the Y direction extending member is 50 cm or more. The width of the region for performing printing in the Y direction is more preferably 60 cm or more.

In case of configuring as above, for example, since the distance to move the inkjet head in the Y direction is elongated, the weight of the Y direction extending member becomes heavy. Due to this, for example, in case of performing the feed operation by the conventional configuration, the influence of the vibration becomes large, and there is a risk that the highly accurate printing cannot be performed appropriately. With respect to this, by configuring as above, the influence of the vibration can appropriately be suppressed. Further, due to this, printing with high accuracy can appropriately be performed.

(Configuration 9) The printing can be performed on the print object having a height, in a direction along which the inkjet head discharges the ink droplets, of 10 cm or more.

In case of configuring as above, for example, the height of the position of center of gravity of the entirety of the Y direction extending member and the inkjet printer becomes high, so in the case for example of performing the feed operation by the conventional configuration, the influence of the vibration becomes large, and there is a risk that the highly accurate printing cannot be performed appropriately. With respect to this, by configuring as above, the influence of the vibration can appropriately be suppressed. Further, due to this, printing with high accuracy can appropriately be performed.

It should be noted that in the case of the configuration with the high position of center of gravity, for example, if the feed operation is performed by the conventional configuration, even in a case where the width of the region to perform printing in the Y direction is smaller, it can be said that the influence of the vibration is likely to be generated. For example, the influence of the vibration is expected to be likely generated in case where the width of the region to perform printing in the Y direction is about 30 cm or more. With respect to this, by configuring as above, even in the case where the width of the region to perform printing in the Y direction is about 30 cm or more, the influence of the vibration can appropriately be suppressed.

(Configuration 10) There is provided a printing method configured to perform printing using an inkjet scheme on a print object, wherein the method uses an inkjet head that discharges ink droplets, a Y direction extending member that retains the inkjet head by making the inkjet head face the print object and that extends in a Y direction predeterminedly set in the inkjet printer, and an X direction driving section that moves the Y direction extending member in an X direction orthogonal to the Y direction, upon printing, the inkjet head is moved along the Y direction extending member and is caused to discharge the ink droplets toward the print object and the X direction driving section includes a ball screw and moves the Y direction extending member in the X direction in accordance with a rotation amount of the ball screw. By configuring as above, for example, advantages similar to those of Configuration 1 can be obtained.

Effects of the Invention

According to the present invention, highly accurate printing can be performed appropriately on print objects of various shapes.

BRIEF DESCRIPTION OF THE DRAWINGS

FIG. 1A is a front view of the inkjet printer 10. FIG. 1B is a right side view of the inkjet printer 10.

EMBODIMENTS OF THE INVENTION

Figure 1A:
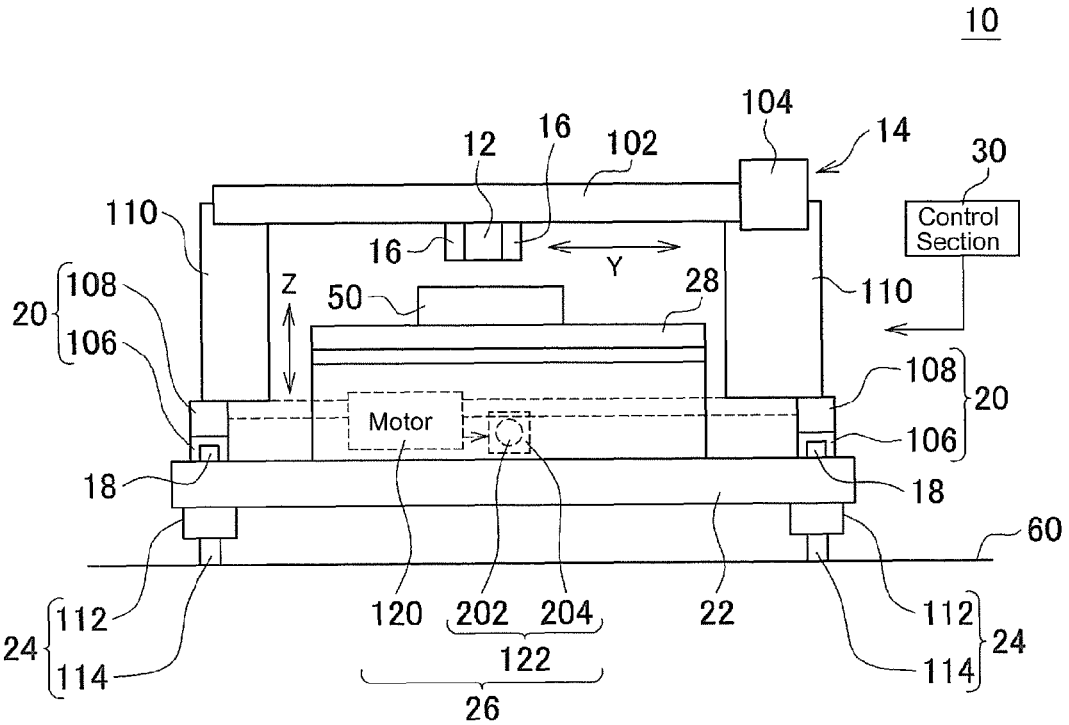
FIG. 1A and FIG. 1B are diagrams showing an example of a configuration of an inkjet printer 10 according to an embodiment of the present invention.
Figure 1B:
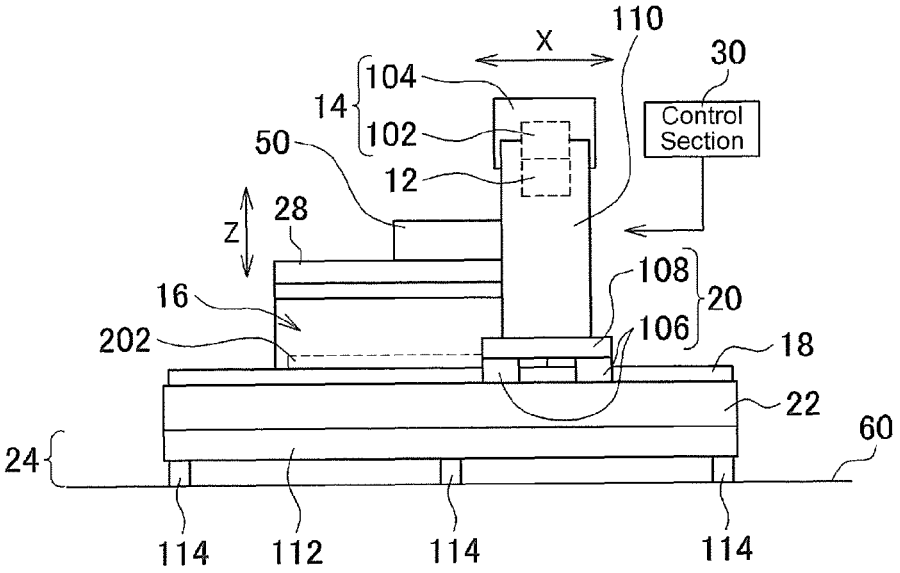

Hereinbelow, embodiments according to the present invention will be described with reference to the drawings. FIG. 1A and FIG. 1B are diagrams showing an example of a configuration of an inkjet printer 10 according to an embodiment of the invention, and a primary part of the inkjet printer 10 is shown in a simplified manner. FIG. 1A is a front view of the inkjet printer 10. FIG. 1B is a right side view of the inkjet printer 10.

It should be noted that in FIG. 1A and FIG. 1B, for the sake of the convenience of description, the configurations of the respective parts of the inkjet printer 10 are shown by suitably adjusting the size and specific arrangement and the like so that the feature is more easily understood. Further, a more detailed configuration of the inkjet printer 10 will be shown in FIG. 2 to FIG. 6.

The inkjet printer 10 is an inkjet printer that performs printing by an inkjet scheme on a print object 50 such as a three-dimensional object and the like, and for example, has a configuration that can print on the print object 50 with a height of 10 cm or more. An upper limit of the height of the print object 50 may be 15 cm or more. It should be noted that the height of the print object 50 is a height in a direction along which an inkjet head discharges ink droplets. In this example, this direction is a Z direction shown in the drawing, and is parallel to a direction of gravity.

Further, a width of a region that can be printed by the inkjet printer 10 in a Y direction is for example 30 cm or more, preferably 50 cm or more (for example, 50 cm to 80 cm), and more preferably 60 cm or more. Further, the width of the printable region in an X direction is for example, 25 cm or more (for example, 25 cm to 50 cm), and more preferably 40 cm or more.

It should be noted that in this example, the Y direction is a direction along which the inkjet head moves along a guide rail upon a main scanning operation (scanning operation). The width of the printable region in the Y direction is for example a width of the region where the inkjet head performs printing upon the main scanning operation. Further, the X direction is a direction that is orthogonal to the Y direction and the Z direction. A width of the printable region in the X direction is for example a width of a movable region of the inkjet head in the feed operation for relatively moving the inkjet head in the X direction with respect to the print object.

Further, the height of the entirety of the inkjet printer 10 of this example is for example 85 cm or more, and more preferably 90 cm or more. Further, the width of the entirety of the inkjet printer 10 in the Y direction is for example 120 cm or more, and more preferably, 140 cm or more. Further, the width of the entirety of the inkjet printer 10 in the X direction is for example 80 cm or more, and more preferably, 90 cm or more.

Further, in this example, the inkjet printer 10 is an inkjet printer of a flat-bed type, and includes an inkjet head 12, a Y bar section 14, an ultraviolet irradiating section 16, a media stage 28, a platform section 22, two rails 18, two supporting members 20, an X direction driving section 26, leg sections 24, and a control section 30. A flat-bed type inkjet printer is for example an inkjet printer that performs a feed operation to relatively move the inkjet head 12 with respect to the print object 50 in the X direction by moving the Y bar section 14 in the X direction. It should be noted that in the present example, for the sake of convenience of description, the inkjet head 12 and the ultraviolet irradiating section 16 are formed as separate configurations from the Y bar section 14. However, for example, upon designing an actual inkjet printer 10 and the like, a portion including the inkjet head 12 and the ultraviolet irradiating section 16 can be configured as the Y bar section 14.

The inkjet head 12 is a print head that discharges ink droplets toward the print object 50, and for example, color printing is performed by discharging ink droplets of respective colors of CMYK. The inkjet head 12 may for example discharge ink droplets of ink such as clear ink, other than the respective colors of CMYK. Further, in the present example, the inkjet head 12 discharges ink droplets of ultraviolet curing type ink.

The Y bar section 14 is a configuration for causing the inkjet head 12 to perform the main scanning operation. In the present example, the Y bar section 14 includes a guide rail 102, a Y direction driving section 104, and side surface sections 110. The guide rail 102 is a rail member that retains the inkjet head 12 by causing the inkjet head 12 to face the print object 50. Further, in the present example, the guide rail 102 is an example of a Y direction extending member that extends in the Y direction.

The Y direction driving section 104 is a driving section that moves the inkjet head 12 along the guide rail 102. In the present example, the Y direction driving section 104 is provided at one end side of the guide rail 102 in the Y direction, and moves the inkjet head 12 in the Y direction in accordance with an instruction from the control section 30 upon the main scanning operation. Further, upon printing in the main scanning operation, the inkjet head 12 moves along the guide rail 102, while discharging the ink droplets toward the print object 50. Further, the side surface sections 110 are side surface portions of the Y bar section 14, and cause the inkjet head 12 and the print object 50 face each other by supporting one end and the other end of the guide rail 102 and the Y direction driving section 104.

The ultraviolet irradiating sections 16 are light sources for generating ultraviolet ray (UV light) for curing the ultraviolet curing type ink. In the present example, the ultraviolet irradiating sections 16 are provided at both sides of the inkjet head 12 in the Y direction in a state of being supported on the guide rail 102 together with the inkjet head 12. Further, due to this, upon the main scanning operation, the ultraviolet irradiating section 16 cures the ink discharged from the inkjet head 12 and struck on the print object 50.

The media stage 28 is a table for retaining the print object 50, and causes the print object 50 to face the inkjet head 12 by retaining the print object 50 on its upper surface. Further, in the present example, the media stage 28 is an example of the print object mounting section on which the print object is to be mounted. The media stage 28 has a mechanism to move a position of the upper surface up and down in the Z direction, and adjusts a distance between the inkjet head 12 and the print object 50 by changing the position of the upper surface in accordance with the shape of the print object 50. Further, a jig (attachment) for retaining the print object 50 according to the shape of the print object 50 may for example be attached at the upper surface of the media stage 28. By configuring as above, the three-dimensional objects with various shapes can appropriately be used as the print object 50.

The platform section 22 is a platform-shaped member that is provided on the lower side in the direction of gravity than the respective configurations of the inkjet head 12, the guide rail 102 and the like and mounts these configurations on an upper surface thereof. A width of the platform section 22 in the Y direction is at least preferably wider than the guide rail 102. Further, a width of the platform section 22 in the X direction is at least preferably wider than a range in which the guide rail 102 moves.

The two rails 18 are examples of the guiding member, and guide the movement of the supporting members 20 by extending in the X direction on the platform section 22. Further, due to this, the two rails 18 guide the movement of the Y bar section 14 in the X direction, which is supported by the supporting members 20.

Further, in the present example, each of the two rails 18 is provided at a corresponding end side of the platform section 22 in the Y direction. Due to this, the two rails 18 guide the movement of the Y bar section 14 at the both sides of the Y bar section 14 in the Y direction. It should be noted that as for the positions of the two rails 18, being provided at the corresponding end sides of the platform section 22 in the Y direction means for example being provided at the respective ends, or in the vicinity of the respective ends. The vicinity of an end is for example a position that is away from the end by a certain marginal gap.

The supporting members 20 are members that support the Y bar section 14 on the platform section 22. In the present example, each of the supporting members 20 includes a guided section 106 and a Y bar mounting section 108. The guided sections 106 are portions having the configuration that is movable along the rails 18 in the X direction. The guided section 106 in each of the two supporting members 20 is guided by a corresponding one of the two rails 18. Further, the Y bar mounting sections 108 are members provided between the guided sections 106 and the Y bar section 14, upon which the side surface sections 110 in the Y bar section 14 are mounted to support the Y bar section 14 on the rails 18.

It should be noted that in the configuration shown in FIG. 1A and FIG. 1B, the supporting members 20 include separate Y bar mounting sections 108 respectively on the two guided sections 106. However, in an example of other configurations, for example, one member mounted on both of the two guided sections 106 may be used as a Y bar mounting section 108. In this case, for example, a plate-shaped member extending in the Y direction and traversing the platform section 22 may suitably be used as the Y bar mounting section 108. By configuring as above, for example, the Y bar section 14 can be supported more stably.

Further, as shown in FIG. 1B, in the present example, each of the supporting members 20 includes two guided sections 106 aligned in the X direction by being apart from one another. By configuring as above, for example, the positions to receive the weight of the Y bar section 14 on the rails 18 can be distributed. Further, due to this, the Y bar section 14 can more appropriately be supported on the platform section 22.

It should be noted that in the present example, the guide rail 102 in the Y bar section 14 and each of the guided sections 106 in the supporting members 20 are disposed by being separated above and under in the direction of gravity with the portion within the media stage 28 where the print object 50 is mounted as the center. Due to this, the configuration of the present example, for example, can be said to be a configuration with a large distance between the center of gravity of the Y bar section 14 and the guided sections 106.

The X direction driving section 26 is a driving section that moves the Y bar section 14 in the X direction along the rails 18. In the present example, the X direction driving section 26 includes a motor 120 and a ball screw 122. The motor 120 is an example of a driving power source for rotating the ball screw 122. The motor 120 may be for example a servo motor.

The ball screw 122 is configured of a ball screw shaft 202 and a ball screw nut 204. In this case, rotating the ball screw 122 refers to rotating the ball screw shaft 202. Further, in the present example, both ends of the ball screw shaft 202 of the ball screw 122 are fixed on the platform section 22 via bearings. Due to this, the ball screw shaft 202 is rotatably supported at a predetermined position in the platform section 22. Further, the ball screw shaft 202 is supported on the platform section 22 in a state having its shaft direction parallel to the X direction. On the other hand, in the ball screw 122 of the present example, the ball screw nut 204 is fixed on the Y bar section 14. The fixation of the ball screw nut 204 to the Y bar section 14 can be performed for example by fixing the ball screw nut 204 on the Y bar mounting sections 108. In this case, as the Y bar mounting sections 108, it is preferable to use plate-shaped members extending in the Y direction and traversing over the platform section 22.

In case of configuring as above, when the ball screw shaft 202 of the ball screw 122 rotates, the ball screw nut 204 progresses or retreats in the X direction in accordance with a direction of the rotation. Due to this, the ball screw nut 204 serves as a converting mechanism for converting the rotation of the ball screw 122 into a linear motion. Further, the Y bar section 14 also moves in the X direction in accordance with the movement of the ball screw nut 204. Due to this, according to the present example, for example, the Y bar section 14 can appropriately be moved in the X direction by the ball screw 122. Further, in case of configuring as above, for example, since it is possible to surely support the both ends of the ball screw shaft 202 on the platform section 22 being a member with high rigidity, the rigidity of the ball screw 122 can appropriately be increased. Further, due to this, for example, the generation of vibration can appropriately be suppressed. Further, the Y bar section 14 can be moved with even higher accuracy.

It should be noted that for the sake of convenience of description, although not shown, in the present example, the bearings supporting the both ends of the ball screw shaft 202 are fixed to the platform section 22. Further, as to the bearings supporting the both ends of the ball screw shaft 202, it is preferable to support the ball screw shaft 202 by the configuration of ball bearings. By configuring as above, for example, the generation of vibration can more appropriately be suppressed by causing the ball screw shaft 202 to rotate smoothly.

Further, as for the configuration of the ball screw 122, for example, the ball screw nut 204 may be fixed to the platform section 22. In this case, the ball screw shaft 202 is made to pass through the ball screw nut 204 by having its shaft direction parallel to the X direction. Further, a configuration to move the Y bar section 14 by cooperating with a linear motion (progressing and retreating) of the ball screw shaft 202 in the X direction is used. In this case, more specifically, for example, the ball screw shaft 202 may be considered to be supported by bearings attached to the Y bar section 14. Due to this, in case the ball screw shaft 202 rotates, the ball screw shaft 202 progresses and retreats in the X direction on the platform section 22 in accordance with the rotating direction. Further, in accordance with this movement, the Y bar section 14 also progresses and retreats in the X direction. Due to this, in case of configuring as above as well, the Y bar section 14 can be moved in the X direction.

It should be noted that the X direction driving section 26 may further include various configurations and the like for motive power transmission between the motor 120 and the ball screw 122. Further, the X direction driving section 26 may for example move the Y bar section 14 in the X direction between the main scanning operations. Due to this, the inkjet printer 10 performs the feed operation between the main scanning operations. Further, the inkjet printer 10 performs the subsequent main scanning operation after the movement of the Y bar section 14 in the X direction has stopped.

The leg sections 24 are configurations for supporting the platform section 22, and support the platform section 22 on the mounting surface 60 by being provided on a bottom surface side of the platform section 22. The bottom surface side of the platform section 22 is a lower surface side in the direction of gravity. Further, the mounting surface 60 is for example an upper surface of a platform, a floor and the like for setting the inkjet printer 10.

Further, in the present example, the leg sections 24 include two connecting sections 112, and four or more (preferably six or more) projecting sections 114. Each of the connecting sections 112 is a member that is consecutively provided in an elongate shape and in parallel with the rails 18, and is provided at the bottom surface side of the platform section 22. Further, each of the two connecting sections 112 is provided at a corresponding end side of the platform section 22 in the Y direction. By configuring as above, for example, the platform section 22 can be strengthened at the positions where the rails 18 are provided on the platform section 22, and the rigidity of the platform section 22 can appropriately be improved. It should be noted that as can be understood from FIG. 1A and FIG. 1B and the like, in the present example, the connecting sections 112 are formed so as to cross over a plurality of projecting sections 114. Due to this, according to this configuration, it can be said that the rigidity of the leg sections 24 is improved. Further, due to this, it can be said that the rigidity of the rails 18 is increased.

Due to this, according to the present example, the distortion (warpage) generated in the platform section 22 can appropriately be suppressed by receiving the weight of the Y bar section 14 and the like on the rails 18. Further, due to this, for example, the vibration generated in the Y bar section 14 moving along the rails 18 can appropriately be suppressed. Further, even in case that vibration is generated, the time required for attenuation of the vibration can appropriately be shortened.

Further, the projecting sections 114 are portions to be legs of the entire inkjet printer 10, and they support the platform section 22 on the mounting surface 60 by respectively projecting downward in the direction of gravity from the connecting sections 112 and making contact with the mounting surface 60. Further, in the present example, a plurality (more preferably three or more) of projecting sections 114 are provided for each of the connecting sections 112. For example, the projecting sections may be considered to be provided at both ends and a center in the X direction for one connecting section 112. In this case, for example, since three projecting sections 114 are provided for each of the two connecting sections 112, a total of six projecting sections 114 are provided. By configuring as above, the inkjet printer 10 can appropriately be supported on the mounting surface 60.

Further, a positional relationship of the rails 18, the connecting sections 112, and the projecting sections 114 is preferably configured for example so that they align above and under in a straight line in the direction of gravity. More specifically, for example, it is preferable that the connecting sections 112 and the rails 18 are caused to face each other with the platform section 22 sandwiched in between, and the projecting sections 114 and the rails 18 are caused to face each other with the connecting sections 112 and the platform section 22 sandwiched in between. Further, this configuration for example may be said to be a configuration in which the connecting sections 112 are arranged at positions just below the guided sections 106 in the direction of gravity, or in a vicinity thereof. By configuring as above, for example, the distortion in the platform section can more appropriately be suppressed.

The control section 30 is for example a CPU of the inkjet printer 10, and for example, it is provided inside the platform section 22 or the side surface sections 110 and the like, and controls operations of the respective sections of the inkjet printer 10. For example, upon the main scanning operation, the control section 30 causes the inkjet head 12 to perform printing on the respective positions on the print object 50 in the Y direction. Further, upon the feed operation performed between the main scanning operations, the regions on the print object 50 where the print is to be performed in the subsequent main scanning operation is sequentially changed by making the Y bar section 14 move in the X direction by the X direction driving section 26. Due to this, according to the present example, printing can appropriately be performed for the respective positions of the print object 50.

Further, as described above, for example, compared to the case of performing belted drive (driving by a timing belt and the like), feed resolution can be refined to move the Y bar section 14 with high resolution by the difference and the like in a decelerating configuration in the present example, by using the ball screw 122 in the X direction driving section 26. Due to this, according to the present example, the impact generated upon stopping the movement of the Y bar section 14 in the X direction can appropriately be reduced. Further, due to this, at the timing when the movement of the Y bar section 14 is stopped, vibration can be made unlikely to be generated. Further, even in case where vibration is generated, the time required for attenuation of the vibration can be shortened. Moreover, due to this, the vibration can appropriately be attenuated before performing the subsequent main scanning operation.

Due to this, according to the present example, for example, even in the case where the weight of the Y bar section 14 is large and the case where the position of center of gravity is high, the influence of the vibration after the start of the subsequent main scanning operation can appropriately be suppressed. Further, due to this, the highly accurate printing can be performed appropriately.

It should be noted that to suppress the influence of vibration, for example, the subsequent main scanning operation may be considered to be performed after waiting for the vibration to attenuate sufficiently. However, in this case, the time required for the feed operation between the main scanning operations is increased, and printing speed is greatly decreased. Due to this, to appropriately perform printing, it is important to shorten the time required for attenuation of the vibration. In contrast, according to the present example, the configuration that can suppress the generation of vibration can appropriately be realized. Further, even if some degree of vibration is generated, the time required for attenuation of the vibration can appropriately be shortened. Due to this, in the present example, great reduction of the printing speed to consider the time required for attenuation of the vibration and the like will not be necessary. Further, as a result, according to the present example, for example, even if printing is performed at the same timing as the case where the weight of the Y bar section 14 is smaller, or the case where the position of center of gravity is low, high quality printing can be performed appropriately.

Further, in case of attempting to move the Y bar section 14 by the belted drive, for example, if the weight of the Y bar section 14 is heavy, an amount by which the belt is stretched and shrunk by the stress is assumed to be large. Further, as a result, the stopping position of the Y bar section 14 is not determined at high accuracy, and there is a risk that the print quality may be decreased. Further, for example, there is a risk that the belt shrinks at the moment when the driving of the belt is stopped and the Y bar section 14 is vibrated.

In contrast, the ball screw 122 used in the present example has high rigidity compared to the belt and the like. Due to this, according to the present example, the problem caused by stretching and shrinking and the like of the belt can appropriately be suppressed. Further, due to this, the stopping position accuracy of the Y bar section 14 can be increased appropriately. Further, the generation of the vibration can appropriately be suppressed.

Further, in case of attempting to move the Y bar section 14 by the belted drive, for example, the configuration uses a worm gear. Moreover, in this case, generally, the configuration may come to have a not so high motive power transmission efficiency. Due to this, in this case, for example, if the weight of the Y bar section 14 is heavy, there is a risk that the Y bar section 14 cannot appropriately be moved. Contrary to this, according to the present example, the motive power generated by the motor 120 can be transmitted to the ball screw 122 with higher transmission efficiency by using the ball screw 122. Further, due to this, for example, even if the weight of the Y bar section 14 is heavy, the Y bar section 14 can appropriately be moved.

Moreover, in the present example, in addition to suppressing the vibration using the ball screw 122, the influence of the distortion generated in the platform section 22 can appropriately be suppressed by using the connecting sections 112 and the like. Due to this, according to the present example, even in the case that the weight of the Y bar section 14 is heavy, highly accurate printing can be performed more appropriately.

Meanwhile, to suppress the influence of the distortion in the platform section 22, for example, it is considered that a space between two guided sections 106 provided on the rails 18 may be widened in the X direction, or three or more guided sections 106 for one rail 18 may be used. However, in this case, the width of the platform section 22 in the X direction also needs to be made large in accordance with the space between the guided sections 106. Further, as a result, a problem that the size of the inkjet printer 10 becomes large is generated. In contrast, in the present example, by using the connecting section 112 and the like, the distortion of the platform section 22 can appropriately be suppressed without excessively widening the space between the guided sections 106. Further, due to this, the inkjet printer 10 can appropriately be prevented from becoming unnecessarily larger.

Further, to solve the problem caused in the case where the weight of the Y bar section 14 is heavy, for example, it seems that only a part of the Y bar section 14 needs to be moved instead of moving the entirety of the Y bar section 14 in the feed operation. Further, to solve the problem caused in the case where the position of center of gravity is high, for example, it seems that only the rails 18 need to be provided at a higher position to enable the Y bar section 14 or a part thereof to move.

However, in these cases, the device configuration becomes complicated, and the increase in the device size and cost may be caused. Further, compared to the case of directly providing the rails 18 on the platform section 22, realizing the high rigidity may become difficult for the rails 18. Further, the distances and heights between the X direction driving section 26 and the rails 18 become separated apart in the configuration, whereby positioning at high accuracy becomes difficult, which may become a reason of decrease in the accuracy of the feed operation.

With respect to this, in the present example, the ball screw 122 of the X direction driving section 26 and the rails 18 are both provided on the platform section 22 (especially, on the same surface of the platform section 22) as above. Due to this, high rigidity can appropriately be realized for the rails 18. Further, in this case, since positioning between the ball screw 122 and the rails 18 can easily be performed at high accuracy, the highly accurate feed operation can appropriately be realized. Moreover, for example, compared to the case of moving only a part of the Y bar section 14, or the case of providing the rails 18 at high positions, feed operation can further be performed with a simpler configuration. Due to this, according to the present example, for example, highly accurate feed operation can appropriately be realized without unnecessarily complicating the configuration of the inkjet printer 10.

As above, in the present example, for example, even in cases where the weight of the Y bar section 14 is heavy, or the case where the position of center of gravity is high, the influence of vibration or distortion in the platform section can appropriately be suppressed. Further, due to this, even in the configuration in which the width of the guide rail 102 in the Y direction is made larger, or the configuration in which the position of the guide rail 102 is made higher, highly accurate printing can be performed appropriately. Due to this, according to the present example, the configuration in which the width of the printable region in the Y direction is large, or the configuration in which the maximum printable height of the print object 50 is large can appropriately be realized. Further, due to this, for example, highly accurate printing can be performed appropriately on the print objects 50 with various shapes.

Figure 2:
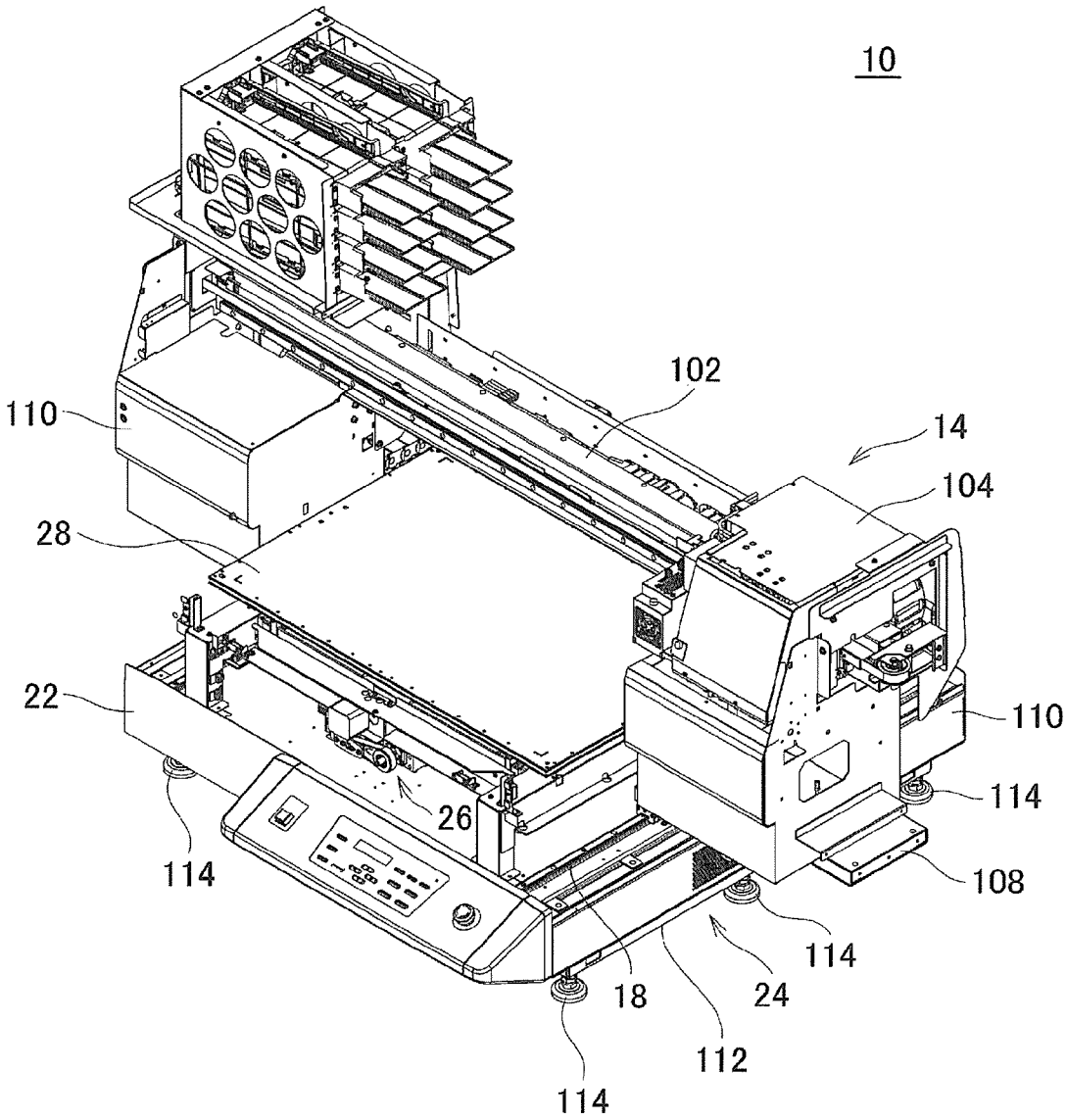
FIG. 2 is a perspective view of the inkjet printer 10 as seeing the inkjet printer 10 obliquely from above.
Figure 3:
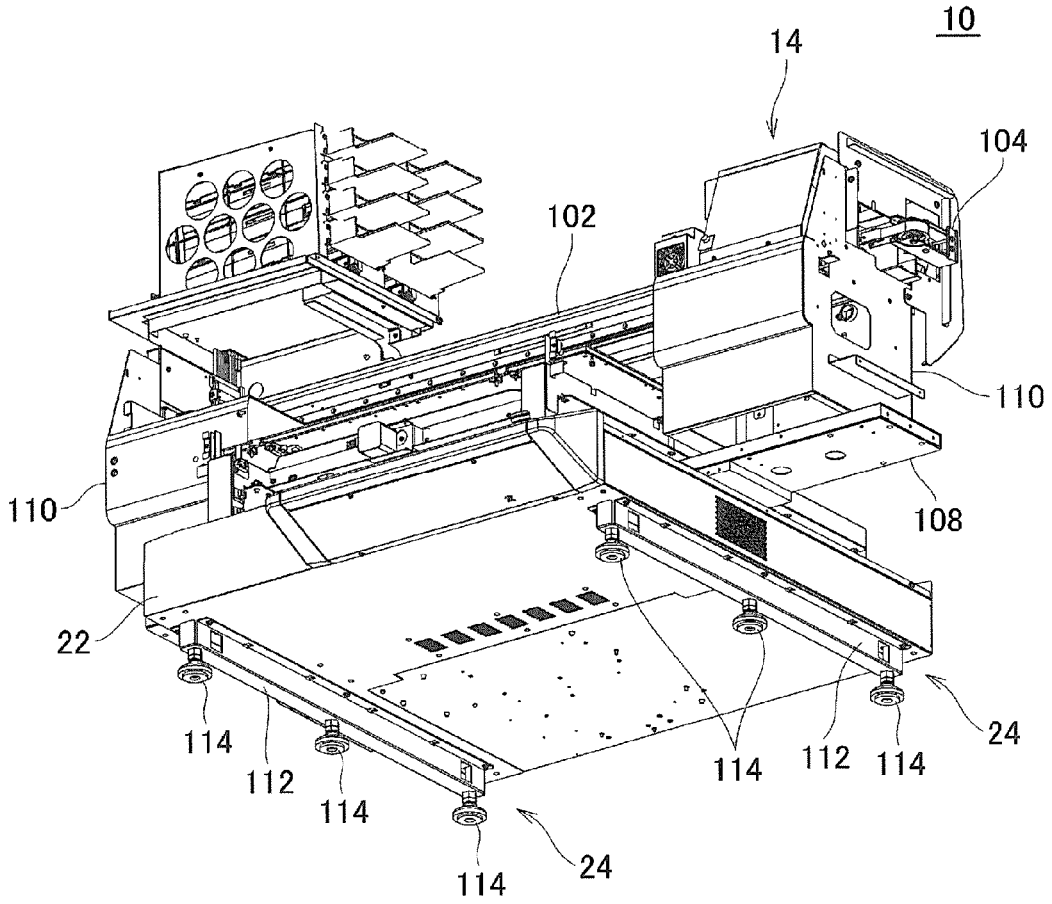
FIG. 3 is a perspective view of the inkjet printer 10 as seeing the inkjet printer 10 obliquely from below.
Figure 4:
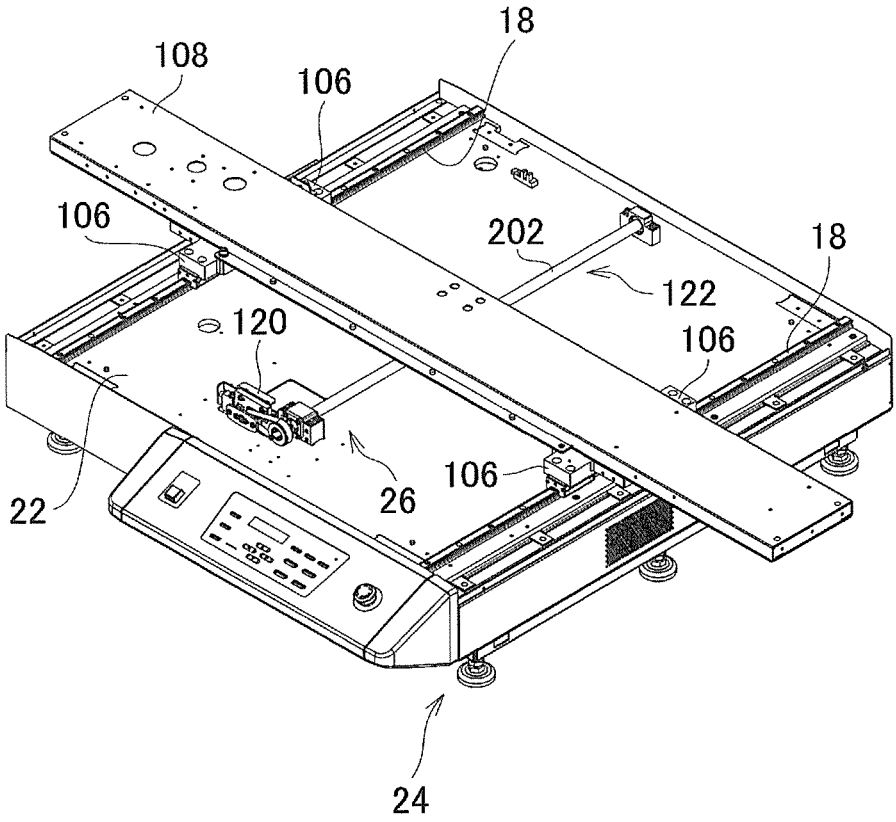
FIG. 4 is a perspective view showing a state in which a Y bar section 14 and a media stage 28 are detached from the inkjet printer 10.
Figure 5:
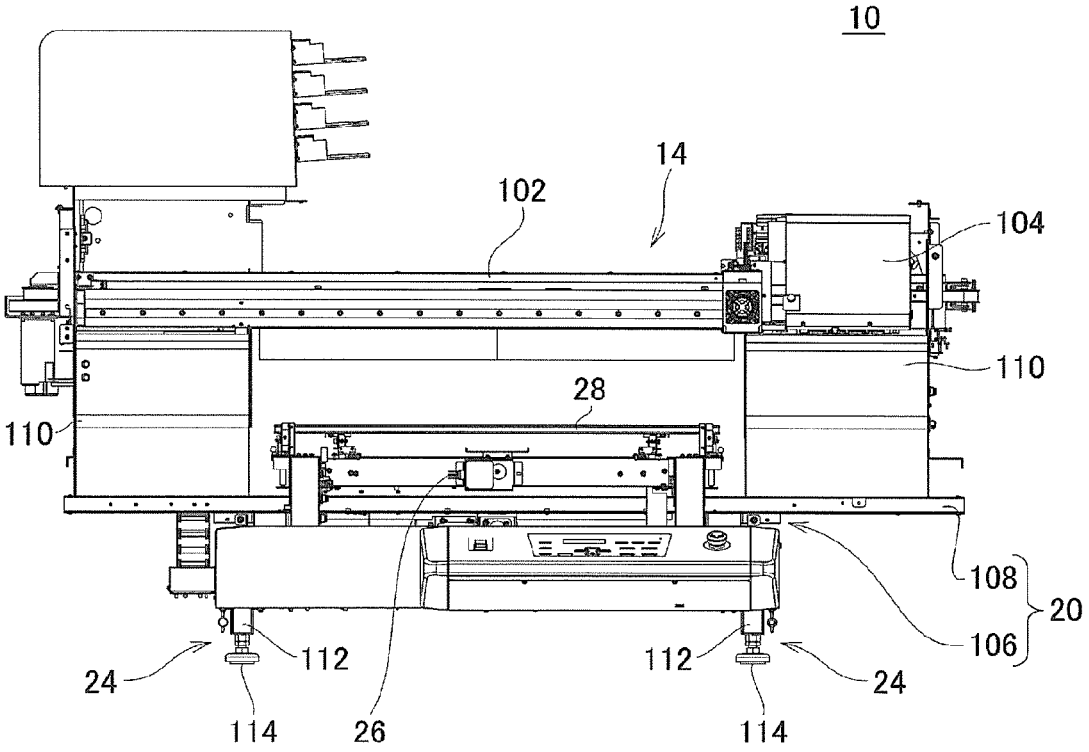
FIG. 5 is a front view of the inkjet printer 10.
Figure 6:
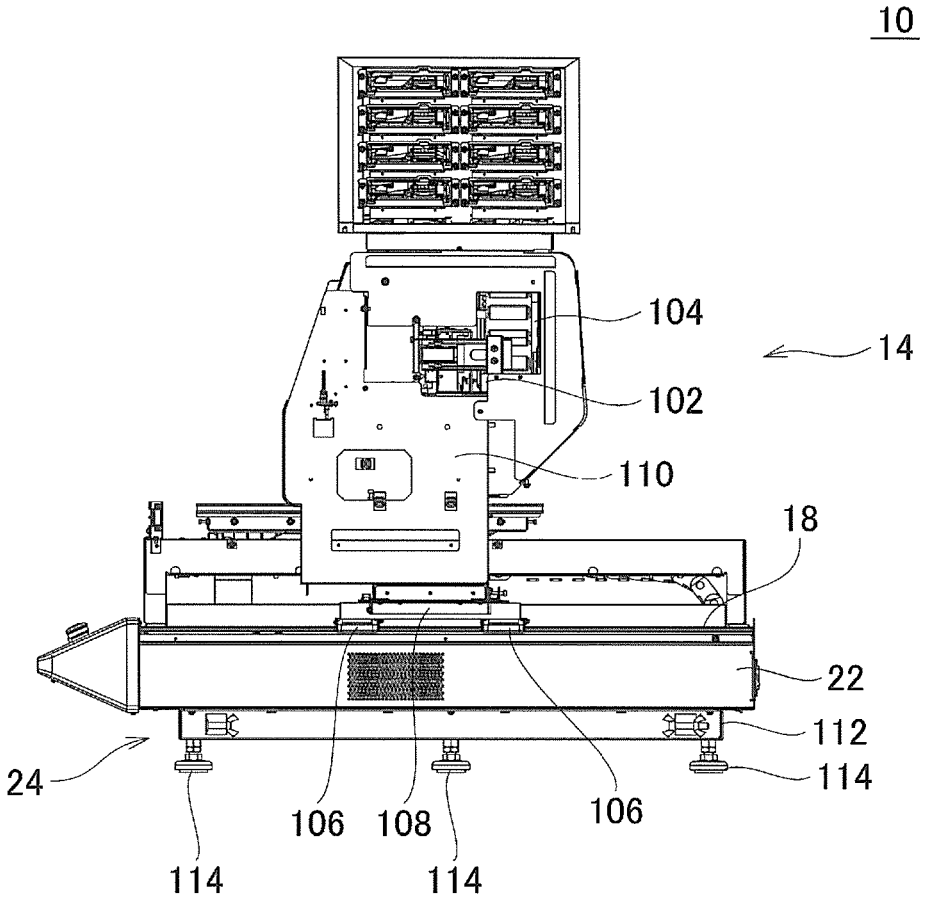
FIG. 6 is a right side view of the inkjet printer 10.

FIG. 2 to FIG. 6 are diagrams showing one example of a more detailed configuration of the inkjet printer 10. FIG. 2 is a perspective view of the inkjet printer 10 as seeing the inkjet printer 10 obliquely from above. FIG. 3 is a perspective view of the inkjet printer 10 as seeing the inkjet printer 10 obliquely from below. FIG. 4 is a perspective view showing a state in which a Y bar section 14 and a media stage 28 and the like are detached from the inkjet printer 10. FIG. 5A is a front view of the inkjet printer 10. FIG. 6B is a right side view of the inkjet printer 10.

It should be noted that in the configuration shown in FIG. 2 to FIG. 6 (hereafter referred to as the configuration of FIG. 2 and the like), a detailed portion and the like of a part of the configuration are different from the configuration shown in FIG. 1A and FIG. 1B. However, this difference is caused by a matter of convenience upon the specific configuration design, and the configurations given the same reference signs as FIG. 1A and FIG. 1B in FIG. 2 to FIG. 6 are identical or similar to the configurations of FIG. 1A and FIG. 1B, aside from the points described below.

In the configuration of FIG. 2 and the like, the height of the entire inkjet printer 10 is about 95 cm. Further, the width in the Y direction is about 150 cm. The width in the X direction is about 100 cm. Further, the width in the Y direction of the printable region by the inkjet printer 10 is 60 cm. Further, the width in the X direction of the printable region is 42 cm.

Further, in the X direction driving section 26, the ball screw shaft 202 of the ball screw 122 moves in the X direction by about 10 mm each time the motor 120 rotates once. A ratio (reduction ratio) of the rotation amount of the motor 120 and the moving amount of the ball screw shaft 202 is for example, about 3:1.

Further, the media stage 28 can move its upper surface in the range of 5 cm in the Z direction, and has the configuration that can attach the jig (attachment) with the high of 10 cm or less to its upper surface. Due to this, the jig can be attached and detached in accordance with the shape of the print object 50 to enable to perform printing on the print objects 50 having the range of the maximum height of 15 cm (for example, the range in which the height is 0.1 mm to 15 cm).

Further, in the configuration of FIG. 2 and the like, as can be understood from FIG. 4 and the like, one member mounted on both of the two guided sections 106 is used as the Y bar mounting section 108. This member is a plate-shaped member that extends in the Y direction and traverses above the platform section 22. Further, since members with such a shape are used as the Y bar mounting sections 108, as can be understood from FIG. 5 and FIG. 6, the media stage 28 has the configuration that passes parts of the members used as the Y bar mounting sections 108 through an internal space. Further, the ball screw nut in the ball screw 122 is fixed to the Y bar mounting sections 108.

As above, according to the configuration of FIG. 2 and the like, for example, printing can be performed on a wide printable region of 60 cm (Y direction)×42 cm (X direction). Further, printing can be performed on the print object 50 with the maximum height of 15 cm.

Here, in the configuration of FIG. 2 and the like, the weight of the Y bar section 14 is made heavier and the position of center of gravity is made higher for performing printing on such a wide print region. Due to this, for example, if the configurations of the portions other than the Y bar section 14 are the same as the conventional configuration, for example, the vibration is expected to be more easily generated when some sort of impact is applied to the Y bar section 14 and the like. Further, when the vibration is generated, the time required for the vibration attenuation is expected to be longer.

Contrary to this, in the configuration of FIG. 2 and the like as well, the X direction driving section 26 having the ball screw 122 is used to appropriately reduce the impact generated upon stopping the Y bar section 14 after the feed operation, for example. Further, due to this, the generation of the vibration can appropriately be suppressed. Further, by using the leg sections 24 having the connecting section 112 and the like, the rigidity of the platform section 22 can appropriately be increased. Further, due to this, the influence of the distortion in the platform section 22 generated upon moving the Y bar section 14 can appropriately be suppressed. Further, even when vibration is generated in the Y bar section 14 and the like, the time required for the vibration attenuation can be shortened. Due to this, also in the specific configuration shown in FIG. 2 and the like, the highly accurate printing can be performed appropriately on the print objects 50 with various shapes.

As above, the present invention has been described by using embodiments, however, the technical scope of the present invention is not limited to the scope described in the embodiments. It is apparent to those skilled in the art that various modifications and improvements can be made to the above embodiments. It is apparent from the description of the claims that embodiments including such modifications and improvements are within the technical scope of the present invention.

INDUSTRIAL APPLICABILITY

The present invention can suitably be adapted for example to an inkjet printer.

DESCRIPTION OF REFERENCE SIGNS

10: Inkjet printer
12: InkJet Head
14: Y bar section (Y direction extending member)
16: Ultraviolet irradiating section
18: Rail (guiding member)
20: Supporting member
22: Platform section
24: Leg section
26: X direction driving section
28: Media stage (print object mounting section)
30: Control section
50: Print object
60: Mounting surface
102: Guide rail
104: Y direction driving section
106: Guided section
108: Y bar mounting section
110: Side surface section
112: Connecting section
114: Projecting section
120: Motor
122: Ball screw
202: Ball screw shaft
204: Ball screw nut

The invention claimed is:

1. An inkjet printer configured to perform printing using an inkjet scheme on a print object, the inkjet printer comprising:
an inkjet head that discharges ink droplets;
a Y direction extending member that retains the inkjet head by making the inkjet head face the print object and that extends in a Y direction predeterminedly set in the inkjet printer; and
an X direction driving section that moves the Y direction extending member in an X direction orthogonal to the Y direction,
wherein upon printing, the inkjet head moves along the Y direction extending member and discharges the ink droplets toward the print object, and
the X direction driving section includes one ball screw and moves the Y direction extending member in the X direction in accordance with a rotation amount of the ball screw,
the inkjet printer further comprising:
a guiding member that guides movement of the Y direction extending member in the X direction by a structure that extends in the X direction; and
a guided section that is disposed at sides of the Y direction extending member, and the Y direction extending member is movable along the guiding member, and the Y direction extending member is movable in the X direction,
the ball screw is disposed at a central position in the Y direction of the Y direction extending member.

2. The inkjet printer according to claim 1, further comprising:
a platform section being a platform-shaped member provided on a lower side in a direction of gravity than the inkjet head and the Y direction extending member;
the guiding member guides movement of the Y direction extending member in the X direction by a structure that extends in the X direction on the platform section; and
a supporting member that includes the guided section movable in the X direction along the guiding member, and the guided section is a member that supports the Y direction extending member on the platform section.

3. The inkjet printer according to claim 2, wherein
at least two of the supporting members and two of the guiding members are provided,
each of the two guiding members is provided at a corresponding end side in the Y direction in the platform section, and
the guided section in each of the two supporting members is guided by a corresponding one of the two guiding members.

4. The inkjet printer according to claim 2, further comprising:
a leg section that supports the platform section on a mounting surface to mount the inkjet printer,
wherein the leg section includes:
a connecting section that is provided in parallel in an elongate shape with the guiding member at a surface on an opposite side of a surface of the platform section where the guiding member is provided; and
a plurality of projecting sections that supports the platform section on the mounting surface by projecting downward in the direction of gravity from the connecting section and making contact with the mounting surface.

5. The inkjet printer according to claim 4, wherein
the connecting section is provided at a position facing the guiding member with the platform section being sandwiched in between, and
the projecting sections are provided at positions facing the guiding member with the connecting section and the platform section being sandwiched in between.

6. The inkjet printer according to claim 4, wherein
the connecting section is provided at a position that is to be just below the guided section in the direction of gravity or in a vicinity thereof.

7. The inkjet printer according to claim 1, wherein
a width in the Y direction of a region where the inkjet head performs printing by moving along the Y direction extending member is 50 cm or more.

8. An inkjet printer configured to perform printing using an inkjet scheme on a print object, the inkjet printer comprising:
an inkjet head that discharges ink droplets;
a Y direction extending member that retains the inkjet head by making the inkjet head face the print object and that extends in a Y direction predeterminedly set in the inkjet printer; and
an X direction driving section that moves the Y direction extending member in an X direction orthogonal to the Y direction,
wherein upon printing, the inkjet head moves along the Y direction extending member and discharges the ink droplets toward the print object, and
the X direction driving section includes one ball screw and moves the Y direction extending member in the X direction in accordance with a rotation amount of the ball screw,
the inkjet printer further comprising:
a platform section being a platform-shaped member provided on a lower side in a direction of gravity than the inkjet head and the Y direction extending member;

a guiding member that guides movement of the Y direction extending member in the X direction by a structure that extends in the X direction on the platform section; and a supporting member being a member that supports the Y direction extending member on the platform section and that includes a guided section movable in the X direction along the guiding member;

the inkjet printer further comprising:

a print object mounting section on which the print object is mounted, wherein each of the Y direction extending member and the guided section is arranged above and under each other by being apart in the direction of gravity, with a portion where the print object is mounted in the print object mounting section as a center.

9. An inkjet printer configured to perform printing using an inkjet scheme on a print object, the inkjet printer comprising:

an inkjet head that discharges ink droplets;

a Y direction extending member that retains the inkjet head by making the inkjet head face the print object and that extends in a Y direction predeterminedly set in the inkjet printer; and an X direction driving section that moves the Y direction extending member in an X direction orthogonal to the Y direction, wherein upon printing, the inkjet head moves along the Y direction extending member and discharges the ink droplets toward the print object, and the X direction driving section includes one ball screw and moves the Y direction extending member in the X direction in accordance with a rotation amount of the ball screw, wherein the inkjet printer is capable of performing printing on the print object having a height, in a direction along which the inkjet head discharges the ink droplets, of 10 cm or more.

10. A printing method configured to perform printing using an inkjet scheme on a print object, wherein the printing method uses:

an inkjet head that discharges ink droplets, a Y direction extending member that retains the inkjet head by making the inkjet head face the print object and that extends in a Y direction predeterminedly set in the inkjet printer, an X direction driving section that moves the Y direction extending member in an X direction orthogonal to the Y direction, a platform section being a platform-shaped member provided on a lower side in a direction of gravity than the inkjet head and the Y direction extending member, a guiding member that guides movement of the Y direction extending member in the X direction by a structure that extends in the X direction on the platform section, and a guided section that is disposed at sides of the Y direction extending member, and the Y direction extending member is movable along the guiding member, and the Y direction extending member is movable in the X direction, upon printing, the inkjet head is moved along the Y direction extending member and is caused to discharge the ink droplets toward the print object; and the X direction driving section includes a ball screw and moves the Y direction extending member in the X direction in accordance with a rotation amount of the ball screw, and the ball screw is disposed at a central position in the Y direction of the Y direction extending member.

* * * * *